United States Patent [19]

Small

[11] Patent Number: 4,669,341

[45] Date of Patent: Jun. 2, 1987

[54] EXTRACTION DEVICE

[76] Inventor: Thomas J. Small, 667 Farm Rd., Malborough, Mass. 01752

[21] Appl. No.: 751,665

[22] Filed: Jul. 3, 1985

[51] Int. Cl.[4] ..... B25B 7/02

[52] U.S. Cl. ..... 81/418; 81/463; 81/424.5; 81/426.5; 81/423; 269/53

[58] Field of Search ..... 81/463, 418, 424.5, 81/426, 185.1, 186, 421, 426.5, 422, 423; 29/254, 255, 275; 72/409, 410; 269/53, 54, 54.4, 54.5

[56] References Cited

U.S. PATENT DOCUMENTS

| | | | |
|---|---|---|---|
| 442,426 | 12/1890 | Donnelly | 81/423 |
| 2,495,308 | 1/1950 | Amigone | 81/426.5 |
| 3,367,703 | 2/1968 | Pittis | 81/418 X |
| 3,585,704 | 6/1971 | Schroeder | 29/275 |
| 3,597,775 | 8/1971 | McCasland | 81/426 X |
| 3,791,012 | 2/1974 | Jenkin | 81/463 X |
| 4,307,635 | 12/1981 | Genova | 81/463 |
| 4,386,542 | 6/1983 | Verna | 81/424.5 X |
| 4,505,011 | 3/1985 | Dupuy | 81/418 X |

*Primary Examiner*—Frederick R. Schmidt
*Assistant Examiner*—Bradley I. Vaught

[57] ABSTRACT

A workpiece to which traction to be applied is firmly held by a gripping device to which is anchored one end of an impacting hammer having a rectilinear guide with a free end directed away from the workpiece. An impact member of high inertia is slidably disposed on the guide for rapid movement toward an impacting engagement with an abutment carried by the guide adjacent its free end, whereby the resulting tensional forces in the form of a sudden impulse are transmitted through the gripping device to the workpiece for use, for example, in withdrawing the workpiece from a member in which it is firmly anchored or embedded. The gripping arrangement of at least one jaw of the gripping device utilizes a single tooth which is harder than the workpiece to be extracted so that such tooth effectively bites into such workpiece to provide a firmer grip. In another embodiment, each jaw may include a tooth each biting into the workpiece in alignment with each other or in staggered alignment. The impacting hammer is designed to provide maximum force during extraction, to reduce operator fatigue, and to be removable so that the gripping device may be used alone or in combination with one or more other tools.

24 Claims, 2 Drawing Figures

EXTRACTION DEVICE

BACKGROUND OF THE INVENTION

The present invention relates to an improved extraction device such as is particularly adapted for removing pins from the flywheels of clutch assemblies used in automobiles with minimum effort and expenditure of time.

It is necessary, from time to time, to repair such clutch assemblies and accordingly they must be disassembled. Due to the fact that such assemblies are held together with such pins, they must be removed. The pins, in addition to being unheaded, are quite strongly and firmly embedded in the assembly. It has been difficult in the past to extract such pins without undue expenditure of time and difficulty, as well as risk of damage to the flywheel itself.

One work gripping device used for extraction of objects is of the type shown in U.S. Pat. No. 2,514,130 to Jones, in which one of the work gripping jaws and its associated handle are fixedly interconnected as part of a stationary clamp member, while a movable jaw is pivotally connected to the member for swinging movement toward and away from the fixed jaw, and is releasably locked in a predetermined relation to the fixed jaw and in clamping engagement with the workpiece, by means of a toggle linkage in which the remote ends of the links are respectively pivotally connected to the movable jaw and to the member at locations eccentic to the pivotal connection between the movable jaw and such member.

Another work gripping device is shown in U.S. Pat. No. 3,791,012 to Jenkin. Jenkin uses the gripping device of Jones and has coupled thereto an impacting hammer which is pivotally mounted to the gripping device in order to enable alignment of pull of the impacting hammer with the object, such as a bent pin, to be pulled. By this arrangement, maximum force is not applied during extraction because of the resiliency of the pivot mechanism. Further, the impact member of the impacting hammer includs a design which is fatiguing on the operator thereof due to the collar design with which the back of the operator's hand comes in contact upon each impact of the hammer. In addition, by using normally available gripping teeth on the jaws of the gripping device, the grip on the object to be extracted may loosen particularly where such object is firmly secured such as for example the pins in a flywheel of an automobile's clutch assembly.

It is accordingly an object of the present invention to provide an improved gripping device in combination with an improved impacting hammer such that maximum force can be applied during extraction, such that the grip will not easily loosen even for firmly embedded objects, such that operator fatigue is reduced, and such that a more universal tool set is readily available to the operator.

SUMMARY OF THE INVENTION

In accordance with the present invention, there is provided a suitable device for firmly gripping a workpiece and to such device there is anchored one end of a guide of an impacting hammer having an inertia or impact member freely slidable thereon for impacting engagement against an abutment fixed to the guide adjacent its free end remote from the gripping device, so that the impact member may be employed to impart one or more blows to the abutment for transmission by tension through the guide and gripping device to the workpiece in a predetermined direction corresponding to the lengthwise orientation of the elongated guide.

The gripping device includes two jaws, at least one of which is of unique design in order to enable a firmer grip on the object to be pulled. Such jaw, in one embodiment, may be readily removable. In one embodiment of the present invention, the use of two jaws of such unique design are used with the biting portions of each jaw in staggered relationship with the object to be pulled. The impacting hammer is rigidly coupled to the gripping device in order to transfer the maximum possible force for the extraction. The slidable impact member is designed to reduce fatigue and injury to the hand of the worker using the device. Further, the impacting hammer may be easily removed from the gripping device in order to enable use of the gripping device without the impacting hammer attached or in order to enable mounting with such gripping device one or more additional tools so that they are readily available in the worker's hands when he is using the gripping device.

Although the present invention has been conceived primarily for the purpose of facilitating the extraction of pins from the flywheel of a clutch assembly, it is also manifestly capable of more general use in applying a lengthwise traction or tension force in the form of directionally oriented force impulses, to various elongated articles or workpieces.

BRIEF DESCRIPTION OF THE DRAWINGS

The advantages of the foregoing configurations of the present invention will become more apparent upon reading the accompanying detailed description in connection with the figures in which.

DETAILED DESCRIPTION OF THE PREFERRED EMBODIMENT(S)

Figure 1:
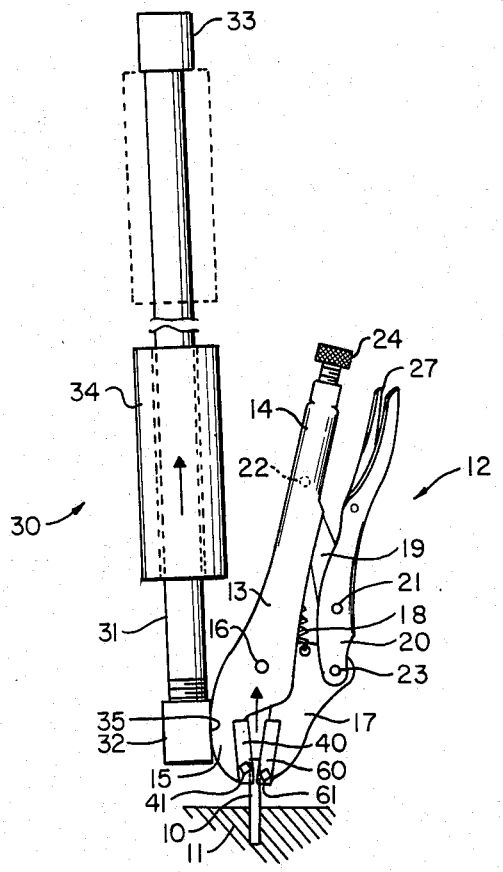
FIG. 1 is an illustration of one embodiment of the extraction device of the present invention.
Figure 2:
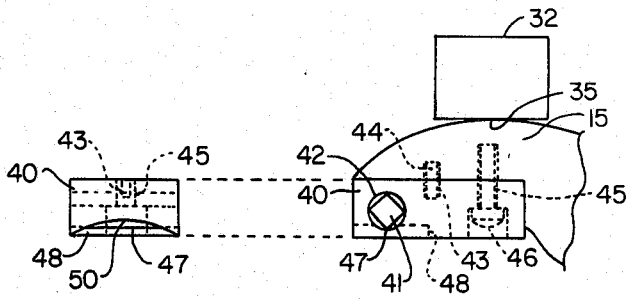
FIG. 2 shows a detailed view of the side and end of a subassembly of at least one gripping jaw of the extraction device of the present invention.

Referring to FIGS. 1 and 2, the workpiece to be extracted is shown by way of example as one pin 10 in assembly 11. The improved extraction device of the present invention is shown in its preferred use in pulling or extracting the pin 10 from the assembly 11. As one of the elements of the novel combination herein disclosed and claimed, there is employed a gripping device, generally designated by the reference numeral 12, to be applied to a selected pin 10 in gripping engagement therewith in the manner illustrated, and there is illustrated an impacting hammer 30 coupled to the gripping device 12.

The gripping device 12 herein specifically illustrated is, except for at least one of jaw subassemblies 40 and 60, of conventional construction, such as exemplified in U.S. Pat. Nos. 2,514,130 and 3,791,012. The device comprises a stationary clamping or gripping member 13 including a rigid handle or lever 14 to one end of which is affixed a stationary gripping or clamping jaw 15. Jaw 15 includes jaw subassembly 40 which includes a single gripping tooth 41 mounted substantially orthogonally to the direction of pull. The details of such jaw subassembly 40 are shown in FIG. 2 and shall be discussed hereinafter.

Pivotally attached to the member 13 at 16 is the movable jaw 17 which preferably is normally resiliently biased away from the jaw 15 by a spring 18, but which may be securely held or locked by means of a suitable toggle linkage to secure and maintain the device in gripping engagement with the element to be pulled, e.g., pin 10. The toggle linkage comprises the rigid toggle links 19 and 20, pivotally interconnected by the toggle knee 21, with the relatively remote ends of the links pivotally connected respectivelly to the member 13 at 22 and to the movable jaw 17 at 23, it being noted that both pivotal connections 22 and 23 are spaced from and eccentric to the jaw pivot 16 so that movement of the toggle knee 21 toward the member past a dead center position between the pivots 22 and 23 will urge the jaw 17 about the pivot 16 and toward the jaw 15 to maintain the jaws 15 and 17 in firm gripping engagement with the pin 10. Jaw 17 includes a jaw subassembly, in place of jaw subassembly 60, which may be of conventional design as shown in U.S. Pat. No. 2,514,130, or may be a jaw subassembly 60, with single gripping tooth 61, similar to jaw subassembly 40 and tooth 41, respectively. The single gripping teeth 41 and 61 may be aligned so as to grip the object to be pulled on the same plane, or may preferably be staggered, as shown, so as to help prevent any breakage of the object to be pulled.

The pivotal connection 22 is carried at the inner end of a screw 24 for adjustment lengthwise of the handle or lever 14, in a manner more fully disclosed in the abovementioned U.S. Pat. No. 2,514,130 for suitably varying the spacing between the jaws 15 and 17 in their relatively closed or gripping position, whereby to adapt them for use with workpieces of varying sizes and diameters. Also, as disclosed in such patent, release of the gripping device from the workpiece may be facilitated by use of a releasing lever 27.

In combination with the gripping device 12, the invention comprises an impact producing means or mechanism, i.e., an impacting hammer, comprising a guide here illustrated as an elongated rigid rod 31 having a lower end mounted such as for example, by screw thread connection to anchor 32 which in turn is permanently mounted, such as by welding at the area 35 between jaw 15 and anchor 32. At its free end, the guide 31 is formed with a radial enlargement or abutment 33. An impact member or weight 34 here exemplified by a generally cylindrical tubular metal sleeve of considerable mass and inertia, is freely slidable on the guide 31 between the anchor 32 attached to gripping device 12 and the abutment 33 at the free end of the guide for impacting engagement with the abutment 33. Abutment 33 may conviently comprise a conventional nut threaded onto the guide 31 or may be a welded piece. Because guide 31 is screwed into anchor 32, it can be seen that the impacting hammer 30 can be easily removed so that the gripping device can be used without the impacting hammer. Also, with the impacting hammer 30 removed, another tool, not shown, may be inserted in the anchor 32 so that such other tool and the griping device are in the operator's hands without the need to put one tool down and pick the other one up. For example, such other tool may include a screwdriver.

The weight or impact member 34 is proportioned for convenient reception in the operator's hand whereby it may be slid up and down the guide 31 to impact against the abutment 33 as many times as may be necessary to withdraw the pin 10 from assembly 11.

Preferably, the impact member or weight 34 has a larger diameter than abutment 33 so that the user's hand will not be constantly jarred against the abutment 33 but rather is free to move slightly when the impact member 34 impacts with abutment 33, thereby reducing the operator's fatigue due to such operation.

It is to be observed that the connection 35 by which the guide 31 is anchored via anchor 32 to the stationary clamping or gripping member 13 is preferably fixed in a position such that the guide 31 is parallel to the axis of pull of the pin 10. This parallel arrangement enables the impacting force or traction to be applied substantially in alignment with the root of the pin 10, thereby enabling substantially all of the extraction force to be applied in pulling the pin 10. In addition, by rigidly securing the impacting hammer 30 to the gripping device 12, the extraction force is more effectively transferred to the pin 10.

Referring more particularly to FIG. 2, details of jaw subassembly 40 are shown by way of a side view and an end view. Subassembly 40 is shown as a removable piece, however it could be permanently secured to jaw 15 such as by welding. In the removable embodiment shown, the subassembly 40 is secured to jaw 15 by a screw 46 in hole 45 threaded into jaw 15, and by an alignment pin 44 in hole 43. A single tooth 41 is secured in hole 42 near the outermost end of the jaw 15. Tooth 41 may be secured in hole 42 by siliver soldering. Tooth 41 has a biting edge 47 oriented substantially transverse to the direction of pull and may be limited to protrusion just below a cutout in subassembly 40, which cutout may have a back wall 48 and a curvature 50 which is matched in diameter to the largest diameter pin to be pulled. The tooth 41 is made of sufficiently hard steel, harder than the object to be extracted, such that it will bite into the object to be pulled and accordingly provide a much firmer grip. The curvature 50 strengthens the subassembly 40 and helps insure that the bite is not too deep thereby helping prevent potential breakage of the pin 10. The subassembly 40 is also preferably made of hard steel but need not be as hard as tooth 41. Should subassembly 40 be damaged, it can be seen that it may be easily replaced without need to replace the entire tool. Jaw subassembly 60 may be of the conventional design shown in the above mentioned patents or may be of the unique design shown in detail for jaw subassembly 40. In the design shown, the tooth 61 is staggered in its relationship with tooth 41, thereby helping prevent breakage of pin 10, however such teeth need not be so staggered. The use of the jaw subassemblies 40 and 60 with their teeth provides a very firm grip of the pin 10 thereby enabling the operator to pull the pin 10 with relative ease.

In the use of the present invention, which is believed to be apparent from the foregoing disclosure, the gripping member 12 is applied to the particular pin 10 to be withdrawn, in the manner illustrated in FIG. 1. After the gripping device 12 is thus applied to and locked in gripping relation on the preselected pin, the workman grasps the impact weight 34 and then the weight of member 34 is manually moved to impact it against the abutment 33 in such number of strokes as may be necessary to effect complete withdrawel of the pin 10. The impacting force manifestly will be transmitted as tension through the guide 31, the anchor 32 and the fixed clamping or gripping member 13, the jaw pivot 16 and jaws 15 and 17, to the pin 10, in a manner so as to remove the pin 10 with improved grip and maximum force.

Numerous objects and advantages of the present invention have been set forth in the foregoing description, together with details of the structure and functions of the invention, and the novel features thereof are pointed out in the appended claims. The disclosure, however, is illustrative only, and changes may be made in detail, especially in matters of shape, size and arrangement of parts, within the principles of the invention, to the full extent indicated by the broad general meaning of the terms in which the appended claims are expressed.

Having described the invention, what is claimed as new and novel and for which it is desired to secure Letters Patent is:

1. An extraction device comprising:

A. a stationary clamp member, including a first jaw and handle rigidly connected thereto;

B. a movable jaw pivotally connected to said stationary clamp member for swinging movement toward and away from said first jaw for gripping a workpiece between said jaws;

C. a toggle linkage extending between and pivotally connected to said stationary clamp member and said movable jaw respectively for selectively locking said jaws in gripping engagement with a workpiece;

D. a rectilinear guide having one end secured to said stationary clamp member such that said guide is maintained in a fixed geometrical relationship with said stationary clamp member, and wherein the other end of said rectilinear guide is free, said free end being on the side of said handle remote from said toggle linkage;

E. an abutment on said guide spaced from said one end;

F. an impact member freely slidable on said guide between said one end and said abutment for impacting engagement with said abutment to urge said jaws and said workpiece in a direction toward said free end of said guide;

G. said one end of said guide is secured to said stationary clamp member in substantial proximity with the location of gripping of said workpiece in order to improve the ease of removal of said workpiece by use of said extraction device in response to said impacting engagement, and wherein said one end of said guide is secured to said stationary clamp member on the side of said member opposite said movable jaw such that said guide is substantially aligned to the direction of urging of said workpiece; and wherein H. at least one of said jaws includes means for imbedding said at least said one of said jaws no greater than a predetermined distance into said workpiece, prior to attempting removal of said workpiece, and wherein said means for imbedding includes a tooth with a biting edge mounted substantially transverse to said direction of urging of said workpiece and said tooth is of sufficient hardness so that said biting edge of said tooth will bite into said workpiece thereby providing a firmer grip thereof, so that said extraction device and said workpiece are firmly engaged during the urging of said workpiece; and wherein I. said tooth is mounted in a subassembly which is removably mounted to said one of said jaws and wherein said subassembly includes a cutout of semicircular shape which is substantially the same diameter of the largest diameter workpiece to be removed, said cutout in proximity with said workpiece and said tooth mounted so that said biting edge of said tooth extends just below the semicircular portion of said cutout in a direction toward said workpiece, whereby said biting edge is limited in the depth of bite of said workpiece so that said workpiece will not break as it is being pulled.

2. A device as in claim 1 further comprising an anchor means coupled between said guide and said stationary member, said anchor means and said guide connected so that said guide may be easily removed.

3. A device as in claim 2 wherein said guide is threaded into said anchor means.

4. A device as in claim 1 wherein said impact member is larger in size than said abutment and is shaped substantially in the form of a cylinder so that an operator's hand may grasp said member and will be free to slide over said abutment during the time of said impacting engagement.

5. A device as in claim 1 wherein said impact member is cylindrical in shape and wherein the circumference of said impact member is larger than the outside dimensions of said abutment so that an operator's hand on said member will be free to slide over said abutment during the time of said impacting engagement.

6. A device as in claim 1 wherein said tooth may be removed from said one of said jaws.

7. A device as in claim 1 wherein said cutout is limited in length in the direction of said urging so that said workpiece can be gripped at a distance from one end thereof which is no greater than said length of said cutout so limited.

8. A device as in claim 1 wherein said means for imbedding is included in said jaw in said stationary clamp member.

9. A device as in claim 1 wherein said means for imbedding is included in said jaw in said movable jaw.

10. A device as in claim 1 wherein said means for imbedding is included in both of said jaws.

11. A device as in claim 10 wherein each of said jaws includes a said tooth wherein said teeth are in substantial alignment on opposite sides of said workpiece.

12. A device as in claim 10 wherein each of said jaws includes a said tooth wherein said teeth are staggered such that the biting edge of said teeth are on different planes so that said workpiece will not be biten into in a manner that may break said workpiece.

13. A device as in claim 1 further comprising an anchor means coupled between said guide and said stationary member, said anchor means and said guide connected so that said guide may be easily removed.

14. A device as in claim 13 wherein said anchor means is secured to said stationary member by welding.

15. A device as in claim 13 wherein said guide is threaded into said anchor means so that said extraction device may be operated, without said guide attached, with another tool threaded into said anchor means, or with said guide threaded into said anchor means, such options solely at the discretion of the operator of said extraction device.

16. A device as in claim 13 wherein said impact member is cylindrical in shape and wherein the outside dimension of said abutment is smaller than the diameter of said impact member and wherin said impact member is shaped such that an operator's hand on said member will be free to slide over said abutment or portion thereof during the time of said impacting engagement.

17. A device as in claim 1 wherein said impact member is in the shape of a cylinder having an outside diameter which is greater than the size of said abutment such that an operator's hand may grasp said member and will be free to slide over said abutment during the time of said impacting engagement.

18. A device as in claim 1 wherein said subassembly housing said tooth is removably mounted on said one of said jaws by use of a screw through said subassembly into said one of said jaws, and wherein said one of said jaws and said subassembly each have holes in alignment with each other, and by use of a pin fitted into said holes in said one of said jaws and in said subassembly.

19. A device as in claim 1 wherein said means for imbedding includes a surface closer to an apparatus from which said workpiece is to be extracted, which said surface comes into contact with said workpiece when said at least one of said jaws is imbedded at substantially said predetermined distance, thereby providing a further gripping action of said workpiece.

20. A device as in claim 1 wherein said means for imbedding is included in each of said jaws.

21. A device as in claim 20 wherein said means for imbedding in each of said jaws includes a tooth and wherein each said tooth included in each of said jaws are in substantial alignment on opposite sides of said workpiece.

22. An extraction device comprising:

A. a stationary clamp member, including a first jaw and handle rigidly connected thereto;

B. a movable jaw pivotally connected to said stationary clamp member for swinging movement toward and away from said first jaw for gripping a workpiece between said jaws;

C. a toggle linkage extending between and pivotally connected to said stationary clamp member and said movable jaw respectively for selectively locking said jaws in gripping engagement with a workpiece;

D. a rectilinear guide having one end secured to said stationary clamp member such that said guide is maintained in a fixed geometrical relationship with said stationary clamp member, and wherein the other end of said rectilinear guide is free, said free end being on the side of said handle remote from said toggle linkage;

E. an abutment on said guide spaced from said one end;

F. an impact member freely slidable on said guide between said one end and said abutment for impacting engagement with said abutment to urge said jaws and said workpiece in a direction toward said free end of said guide;

G. said one end of said guide is secured to said stationary clamp member in substantial proximity with the location of gripping of said workpiece in order to improve the ease of removal of said workpiece by use of said extraction device in response to said impacting engagement, and wherein said one end of said guide is secured to said stationary clamp member on the side of said member opposite said movable jaw such that said guide is substantially aligned to the direction of urging of said workpiece; and wherein H. both said first jaw and said movable jaw include respectively first and second means for imbedding each of said jaws no greater than a predetermined distance into opposite sides of said workpiece, and wherein each of said first and second means for imbedding include a tooth with a biting edge mounted substantially transverse to said direction of urging of said workpiece, so that said extraction device and said workpiece are firmly engaged during the urging of said workpiece; and wherein I. each of said teeth are mounted in different subassemblies which are mounted to different ones of said jaws and wherein each of said subassemblies includes a cutout of semicircular shape which is substantially the same diameter of the largest diameter workpiece to be removed, said cutout in proximity with said workpiece and each of said teeth mounted so that said biting edge of each of said teeth extends just below the semicircular portion of said cutout of each of said subassemblies in a direction toward said workpiece, whereby said biting edge of each of said teeth is limited in the depth of bite of said workpiece so that said workpiece will not break as it is being pulled.

23. An extraction device comprising:

A. a first clamp member;

B. a second clamp member;

C. means for pivotally connecting said first and second clamp members;

D. means for locking said first and second clamp members in gripping engagement with said workpiece;

E. means, coupled to either said first or second clamp member, for providing an impacting force for removing said workpiece from apparatus housing said workpiece; and F. imbedding means, included in at least one of said clamp members, said imbedding means including a tooth with a biting edge arranged substantially transverse to the direction of removal of said workpiece, said biting edge imbedded no greater than a predetermined distance into said workpiece when said means for locking is engaged, thereby providing a first gripping action of said workpiece, and wherein said imbedding means includes a surface closer to said apparatus than is said tooth, which said surface comes into contact with said workpiece when said biting edge is imbedded at substantially said predetermined distance, thereby providing a second gripping action of said workpiece; and wherein G. said tooth is mounted in a subassembly which is mounted to said at least one of said clamp members and wherein said subassembly includes a cutout of semicircular shape which is substantially the same diameter of the largest diameter workpiece to be removed, said cutout in proximity with said workpiece and said tooth mounted so that said biting edge of said tooth extends just below the semicircular portion of said cutout in a direction toward said workpiece, whereby said biting edge is limited in depth of bite of said workpiece so that said workpiece will not break as it is being pulled.

24. A device as in claim 23 wherein said imbedding means is included in each of said clamp members.

* * * * *